US007934351B2

(12) United States Patent
Clarno

(10) Patent No.: US 7,934,351 B2
(45) Date of Patent: May 3, 2011

(54) METHOD OF CONSTRUCTING A BLOCK WALL

(75) Inventor: John L. Clarno, Vancouver, WA (US)

(73) Assignee: Alliance Construction Technologies, Inc., Bloomington, MN (US)

( * ) Notice: Subject to any disclaimer, the term of this patent is extended or adjusted under 35 U.S.C. 154(b) by 299 days.

(21) Appl. No.: 12/118,004

(22) Filed: May 9, 2008

(65) Prior Publication Data

US 2009/0013638 A1 Jan. 15, 2009

Related U.S. Application Data

(60) Provisional application No. 60/928,466, filed on May 9, 2007.

(51) Int. Cl.
*E04B 1/00* (2006.01)

(52) U.S. Cl. ..... 52/741.13; 52/741.14; 52/742.14; 52/745.09; 52/293.3; 52/295; 52/293.2; 405/284; 405/262

(58) Field of Classification Search ..... 52/600, 52/606, 745.09, 741.13, 742.14, 292, 293.2, 52/274, 293.3, 378, 503, 504, 505, 561, 562, 52/565, 604, 741.14, 294, 295, 432, 649.1; 405/284, 262

See application file for complete search history.

(56) References Cited

U.S. PATENT DOCUMENTS

| | | | | | |
|---|---|---|---|---|---|
| 3,430,404 | A | * | 3/1969 | Muse | 52/439 |
| 4,207,718 | A | | 6/1980 | Schaaf et al. | |
| 4,319,440 | A | | 3/1982 | Rassias et al. | |
| 4,524,551 | A | * | 6/1985 | Scheiwiller | 405/286 |
| 4,538,386 | A | * | 9/1985 | DiCello | 52/302.3 |
| 4,726,567 | A | | 2/1988 | Greenberg | |
| 4,790,690 | A | * | 12/1988 | Vidal et al. | 405/262 |
| 4,896,472 | A | | 1/1990 | Hunt | |
| 4,976,087 | A | * | 12/1990 | Pizzino | 52/741.15 |
| 5,139,369 | A | * | 8/1992 | Jaecklin | 405/262 |
| 5,230,189 | A | * | 7/1993 | Sourlis | 52/169.5 |
| 5,350,256 | A | | 9/1994 | Hammer | |
| 5,367,845 | A | * | 11/1994 | Hartling | 52/293.1 |
| 5,567,089 | A | * | 10/1996 | Akamine | 405/285 |
| 5,688,078 | A | | 11/1997 | Hammer | |
| 5,702,208 | A | * | 12/1997 | Hilfiker et al. | 405/302.4 |
| 5,794,393 | A | * | 8/1998 | Fearn | 52/294 |
| 5,839,243 | A | * | 11/1998 | Martin | 52/439 |
| 5,878,544 | A | * | 3/1999 | McKinnon | 52/566 |
| 5,882,540 | A | * | 3/1999 | Farrington | 249/34 |
| 6,010,279 | A | | 1/2000 | Taylor-Smith | |

(Continued)

OTHER PUBLICATIONS

DSM Vista brochure (2 pages).

(Continued)

*Primary Examiner* — Robert J Canfield
*Assistant Examiner* — Matthew J Gitlin
(74) *Attorney, Agent, or Firm* — Popovich, Wiles & O'Connell, P.A.

(57) ABSTRACT

A block wall or fence and methods for constructing a block wall or fence with a footing framework encased in concrete to form a footing support structure wherein the blocks of the wall or fence may be laid without first constructing the footing support framework or first enclosing the footing framework in concrete. Additionally, vertical reinforcing members located in vertical columnar cavities within blocks of the wall and/or horizontal reinforcing members located in horizontal channels within blocks of the wall form a reinforcing framework; wherein some or all of the blocks of the wall or fence may be laid before encasing the reinforcing framework and/or the footing support framework in concrete.

10 Claims, 9 Drawing Sheets

U.S. PATENT DOCUMENTS

| | | | | |
|---|---|---|---|---|
| 6,050,749 | A * | 4/2000 | Khamis | 405/286 |
| 6,412,244 | B2 * | 7/2002 | Nolan | 52/315 |
| 6,431,797 | B2 | 8/2002 | Greenberg | |
| 6,565,289 | B2 * | 5/2003 | Khamis | 405/286 |
| 6,568,141 | B2 * | 5/2003 | Kremers | 52/426 |
| 6,655,107 | B2 * | 12/2003 | Dean | 52/742.14 |
| D514,233 | S | 1/2006 | Hammer | |
| 7,073,304 | B2 | 7/2006 | Hampton et al. | |
| 7,100,886 | B2 | 9/2006 | Hammer et al. | |
| D532,119 | S | 11/2006 | Hammer | |
| 7,328,537 | B2 | 2/2008 | Hammer | |
| 7,591,447 | B2 | 9/2009 | Hammer et al. | |
| D611,168 | S | 3/2010 | Hammer | |
| 2002/0001509 | A1 * | 1/2002 | Hong | 405/286 |
| 2002/0078649 | A1 | 6/2002 | Clapp | |
| 2002/0174614 | A1 * | 11/2002 | Dilon | 52/292 |
| 2005/0116389 | A1 | 6/2005 | Hammer et al. | |
| 2006/0201082 | A1 | 9/2006 | Hammer et al. | |
| 2008/0110118 | A1 * | 5/2008 | Molina | 52/379 |
| 2009/0151281 | A1 * | 6/2009 | MacDonald et al. | 52/251 |

OTHER PUBLICATIONS

DSM Vista Information Packet (12 pages).

* cited by examiner

METHOD OF CONSTRUCTING A BLOCK WALL

This application claims the benefit of U.S. Provisional Application No. 60/928,466, filed May 9, 2007, entitled "Method of Constructing a Block Wall", the contents of which are hereby incorporated by reference herein.

FIELD OF THE INVENTION

This invention relates generally to block walls or fences and methods of constructing walls or fence systems from dry-stack wall blocks. More particularly, the invention relates to walls and fence systems and methods of constructing such walls or fence systems wherein a support footing is poured after courses of blocks which form the wall or fence have been stacked.

BACKGROUND OF THE INVENTION

Generally, free-standing block walls or fences are constructed of concrete blocks (or similar material) in running courses. A trench is usually dug and a concrete footing is prepared by the placement of batter or screed boards for forming a predetermined dimension for the footing's width and thickness. Horizontal reinforcing material, such as steel bars, running both laterally and transversally is tied together forming a cage within the screed board framework. The reinforcing material cage generally has vertical support elements that protrude above the screed board framework which will eventually tie into the vertical wall section and perform as a moment overturn resistance for the lateral forces acting upon the wall or fence structure. Concrete is then poured into the screed board framework and is leveled off so that it is flush with the screed surface. This leveling process can be difficult to achieve around the vertical support elements. The concrete is generally allowed to set for a time and then later a first course of blocks is laid using mortar to level the blocks on the concrete footing. Due to the irregularity of the footing with all the vertical support elements protruding through it, the first course usually requires the use of mortar at the bed and head joints of the blocks in order to ensure that the block is started in a level condition. Each subsequent course is placed in such a manner so that the vertical joints between blocks are staggered in a running bond pattern from a previous course. Mortar is used as a binding agent between the courses and between the ends of each of the blocks. Conventional concrete blocks typically have one or more voids or cores extending through them in the vertical direction to create open vertical columns through the walls. The vertical support elements are accommodated within these vertical columns. The blocks are installed by lifting them over the vertical support elements. The cores or voids are filled with grout to connect the wall to the vertical support elements of the footing to help ensure that the wall is stable. Additional reinforcing bars may be placed in these columns for enclosure with mortar or concrete within the columns, in accordance with building code standards and are connected to the vertical support elements of the footing to help ensure wall stability. Internally reinforced concrete walls may also be designed to utilize horizontal steel rebar reinforcing. Specific design location and steel bar sizing is determined by a qualified structural engineer according to project requirements.

In order for a wall constructed in this manner to be approved, a building inspector normally will require what is known as a "knockout". A "knockout" is an inspection opening in a wall block at or near the base course. This requires that a portion of a block be removed in order to visibly ensure that the concrete grout has fully filled the entire vertical column.

Modular blocks used to build walls, columns, pillars and other structures are known in the art. Such blocks can be installed without special skill and are desirable because they are a convenient size to handle and have low installation costs. However, current methods of constructing walls with those blocks, and especially walls that require a concrete footing have numerous disadvantages. For example, these blocks typically must be used with masonry mortar at both head and bed joints to improve the structural integrity of a wall.

It would be desirable to provide a method for constructing a wall block or fence system with a support footing that is easy to install and can be used to construct mortarless walls, wall corners, fences, columns and other structures.

It would be further desirable to provide a method for constructing a wall block or fence system with a support footing wherein blocks of the wall or fence may be laid without first constructing the support footing prior to building the wall or fence. With conventional masonry walls known in the art, it is not possible to build the wall first and the footing later.

It would be further desirable to provide a method for constructing a wall block or fence system with a support footing wherein the reinforcing cage or framework of the support footing could be constructed after blocks have been laid.

It would be further desirable to provide a method for constructing a wall block or fence system with a support footing wherein concrete could be poured for the support footing after blocks have been laid.

It would further be desirable to provide a method for constructing a wall block or fence system with a support footing wherein concrete poured into columnar voids within the fence containing vertical support elements can be visibly verified to fully flow through the entire column without having to remove portions of concrete blocks near the foundation line.

It would further be desirable to provide a method for constructing a wall block or fence system with a support footing wherein concrete poured into columnar voids within the fence containing vertical support elements can encase the reinforcing cage or framework of the support footing.

It would further be desirable to provide a wall or fence constructed in accordance with the methods described herein.

SUMMARY OF THE INVENTION

This invention is a wall or fence and methods of constructing a wall or fence wherein the footing for the wall or fence is formed after the wall has been built or partially built.

In one aspect, the invention is a wall or fence constructed with multiple blocks that are easy to handle and install and can be used to construct an eye-pleasing wall or fence. The blocks permits construction of stable walls and fences that are curved or straight as well as providing for walls having 90 degree corners.

The blocks are provided with cores, pin-receiving apertures, pin holes and multiple channels. Pins are used in the pin-receiving apertures and pin holes to connect blocks in adjacent courses together. A further reinforcing system is formed by the use of vertical and horizontal reinforcing members within the channels on the blocks and through the cores and enclosed cavities of adjacent blocks.

In another aspect, this invention is a wall or fence with a footing framework encased in concrete to form a footing support structure wherein the blocks of the wall or fence may be laid without first constructing the footing support framework or first enclosing the footing framework in concrete.

In another aspect, this invention is a wall or fence with footing framework and vertical reinforcing members located in vertical columnar cavities within blocks of the wall and/or horizontal reinforcing members located in horizontal channels within blocks of the wall to form a reinforcing framework; wherein some or all of the blocks of the wall or fence may be laid before encasing the reinforcing framework or the footing support framework in concrete.

In another aspect, this invention is a wall or fence with footing framework and vertical reinforcing members that are located in vertical columnar cavities and may have perpendicular legs that are connected to the footing framework, and/or horizontal reinforcing members located in horizontal channels within blocks of the wall to form a reinforcing framework; wherein concrete may be poured into the vertical columnar cavities from a top surface of the wall or when the wall reaches a predetermined height, and may be allowed to flow down through the columnar cavities and out through the gaps of the base layer and may be allowed to cover the footing framework to a pre-determined depth and encase the base layer to form a footing support structure.

In another aspect, this invention is a wall comprising at least a base layer and a first upper course, each course comprising a plurality of blocks; the blocks of the base layer being spaced apart from adjacent blocks by a predetermined distance, the distance creating a gap between blocks, the gaps containing traverse footing reinforcing members that are connected to horizontal footing reinforcing members creating a footing framework; the blocks of each upper course being placed end to end; each block having an upper surface spaced apart from an opposed lower surface, thereby defining a block thickness; opposed first and second faces; the first and second faces together with the upper, lower and side surfaces forming a block body.

The lower surface of the block may have first and second channels substantially parallel to the first and second faces. Each block may have the same thickness. The first and second channels each may open onto one of the side surfaces or onto each of the side surfaces. Each block may have at least one pin receiving cavity and pin hole extending through the block thickness. The pin hole may open onto the upper surface of the block and the pin receiving aperture may open into one of the at least two channels. The wall may further comprise horizontal reinforcing members adapted to fit within one of the first and second channels of the blocks. Each block may further comprise at least one core extending the thickness of the block. Enclosed cavities are formed by the alignment of adjacent side surfaces and may be the same size and shape as the core of the block. The wall may further comprise vertically aligned blocks in the base layer and upper courses and vertical reinforcing members that may have perpendicular legs, adapted to fit through vertical columnar cavities formed by cores and enclosed cavities of vertically aligned blocks. The vertical reinforcing members may also be threaded through the space created by the placement of the horizontal reinforcing members for more accurate alignment of reinforcing framework created by the horizontal and vertical reinforcing members. The perpendicular legs of the vertical reinforcing members of the reinforcing framework may be attached to the transverse and horizontal footing reinforcing members of the footing framework. Concrete may be poured into the vertical columnar cavities from the top of the wall or when the wall reaches a predetermined height, and may be allowed to flow down through the columnar cavities containing the vertical reinforcing members and out through the gaps of the base layer and may be allowed to cover the footing framework to a pre-determined depth and encase the base layer to form a footing support structure, and thus connecting the reinforcing framework to the footing support structure.

In another aspect, this invention is a wall or fence with a support footing formed from a hardened flowable material; a base layer of blocks substantially encased within the support footing, the blocks in the base layer forming a plurality of lateral gaps between blocks in the base layer of blocks; and a plurality of courses of wall blocks stacked on the base layer of blocks such that a plurality of vertical channels are formed between a top surface of an uppermost course of blocks and the plurality of gaps in the base layer of blocks, the vertical channels containing the hardened flowable material.

The wall or fence may have a footing reinforcing framework including horizontal footing reinforcing members extending parallel to the wall or fence and transverse footing reinforcing members extending perpendicular to the wall or fence, the footing reinforcing framework being substantially encased in the support footing. The transverse footing reinforcing members may extend through the plurality of gaps in the base layer of blocks. The wall or fence of claim may have vertical reinforcement members contained within the vertical channels and may also have horizontal reinforcing members positioned between courses of wall blocks. Additionally the flowable material may be concrete.

The blocks of the base layer may be placed on a base material formed from compacted granular material or crushed stone. The blocks of the base layer may be the same structure as the blocks of the wall and may be spaced apart by a desired distance to form lateral gaps. The desired distance may be one-half the distance of the length of the base layer blocks.

In one aspect, this invention is a method of constructing a wall or fence with a footing framework encased in concrete to form a footing support structure wherein the blocks of the wall or fence may be laid without first constructing a footing support framework or first enclosing the footing framework in concrete.

In another aspect, this invention is a method of constructing a wall or fence with footing framework and vertical reinforcing members located in vertical columnar cavities within blocks of the wall and/or horizontal reinforcing members located in horizontal channels within blocks of the wall to form a reinforcing framework; wherein some or all of the blocks of the wall or fence may be laid before encasing the reinforcing framework or the footing support framework in concrete.

In another aspect, this invention is a method of constructing a wall or fence with footing framework and vertical reinforcing members, that are located in vertical columnar cavities and may have perpendicular legs that are connected to the footing framework, and/or horizontal reinforcing members located in horizontal channels within blocks of the wall to form a reinforcing framework; wherein concrete may be poured into the vertical columnar cavities from a top surface of the wall or when the wall reaches a predetermined height, and may be allowed to flow down through the columnar cavities and out through the gaps of the base layer and may be allowed to cover the footing framework to a pre-determined depth and encase the base layer to form a footing support structure.

In another aspect, this invention is a method of constructing a wall comprising at least a base layer and a first upper course, each course comprising a plurality of blocks; the blocks of the base layer being spaced apart from adjacent blocks by a predetermined distance, the distance creating a gap between blocks, the gaps containing traverse footing reinforcing members that are connected to horizontal footing reinforcing members creating a footing framework; the blocks of each upper course being placed end to end; each block having an upper surface spaced apart from an opposed lower surface, thereby defining a block thickness; opposed first and second faces; the first and second faces together with the upper, lower and side surfaces forming a block body.

The lower surface of the block may have first and second channels substantially parallel to the first and second faces. Each block may have the same thickness. The first and second channels each may open onto one of the side surfaces or onto each of the side surfaces. Each block may have at least one pin receiving cavity and pin hole extending through the block thickness. The pin hole may open onto the upper surface of the block and the pin receiving aperture may open into one of the at least two channels. The wall may further comprise horizontal reinforcing members adapted to fit within one of the first and second channels of the blocks. Each block may further comprise at least one core extending the thickness of the block. Enclosed cavities are formed by the alignment of adjacent side surfaces and may be the same size and shape as the core of the block. The wall may further comprise vertically aligned blocks in the base layer and upper courses and vertical reinforcing members, that may have perpendicular legs, adapted to fit through vertical columnar cavities formed by cores and enclosed cavities of vertically aligned blocks. The vertical reinforcing members may also be threaded through the space created by the placement of the horizontal reinforcing members for more accurate alignment of reinforcing framework created by the horizontal and vertical reinforcing members. The perpendicular legs of the vertical reinforcing members of the reinforcing framework may be attached to the transverse and horizontal footing reinforcing members of the footing framework. Concrete may be poured into the vertical columnar cavities from the top of the wall or when the wall reaches a predetermined height, and may be allowed to flow down through the columnar cavities containing the vertical reinforcing members and out through the gaps of the base layer and may be allowed to cover the footing framework to a pre-determined depth and encase the base layer to form a footing support structure, and thus connecting the reinforcing framework to the footing support structure.

In another aspect, this invention is a method for constructing a wall or fence by preparing a level base; laying a base layer of blocks on the base, the base layer of blocks forming a plurality of lateral gaps; stacking a plurality of courses of wall blocks on the base layer of blocks such that a plurality of vertical channels are formed between a top surface of an uppermost course of blocks and the plurality of gaps in the base layer of blocks; and pouring a flowable material from the top surface through the vertical channels and gaps to form a support footing for the wall or fence which substantially encases the base layer of blocks.

The method for constructing a wall or fence may also include forming a trench; and adding base material to the trench, wherein the step of preparing a level base comprises leveling the base material in the trench.

The method for constructing a wall or fence may further include forming a footing reinforcing framework including horizontal footing reinforcing members extending parallel to the wall or fence and transverse footing reinforcing members extending perpendicular to the wall or fence, the footing reinforcing framework being substantially encased in the support footing. The transverse footing reinforcing members may extend through the plurality of gaps in the base layer of blocks. The method may also include placing vertical reinforcement members contained within the vertical channels and also placing horizontal reinforcing members positioned between courses of wall blocks. Additionally the flowable material may be concrete.

The method for constructing a wall or fence may further include placing the blocks of the base layer on a base material formed from compacted granular material or crushed stone. The blocks of the base layer may be the same structure as the blocks of the wall and may be spaced apart by a desired distance to form lateral gaps. The desired distance may be one-half the distance of the length of the base layer blocks.

BRIEF DESCRIPTION OF THE DRAWINGS

The present invention will now be described by way of example with reference to the accompanying drawings, wherein.

DETAILED DESCRIPTION OF THE PREFERRED EMBODIMENTS

In this application, "upper" and "lower" refer to the placement of the block in a wall or fence. The lower surface faces down, that is, it is placed such that it faces the ground. In forming a wall, one row of blocks is laid down, forming a course. A second course is laid on top of the first course by positioning the lower surface of one block on the upper surface of another block.

This invention comprises walls or fences and methods for constructing the wall or fences from blocks. Although use of a particular block is described in connection with these methods it should be understood that any blocks or modular structure capable of being stacked in a manner that forms vertical open or void columns may be used. The blocks are configured to be compatible with each other in the construction of a partial retaining wall, a parapet wall, a free-standing wall, a sound wall or a fence system. Such walls may be straight, curved, or may have corners and 90 degree angles. Although not a requirement of this invention, each block may have at least one face that is textured in a manner resulting in the appearance of natural stone. When at least two faces of the block has been textured, the orientation of the faces may be reversed so that either the front or the back of the block may serve as an exposed face. Preferably, there is a natural-appearing finish on all exposed sides of the wall. The wall system is designed to be structurally sound and easy to install.

The blocks are provided with pin receiving apertures, pin holes and multiple channels that together provide for a way to positively connect and align courses of blocks to each other in a wall. Reinforcing members can be used vertically in the wall and can be used horizontally within the block channels, thus adding additional strength to the wall.

Figure 1A:
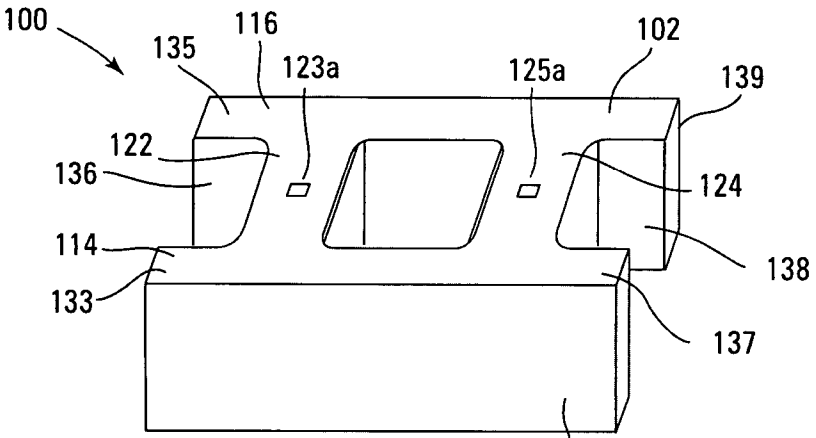
FIGS. 1A, 1B and 1C illustrate perspective, bottom and side views of a retaining wall block suitable for use in practicing the present invention.
Figure 1B:
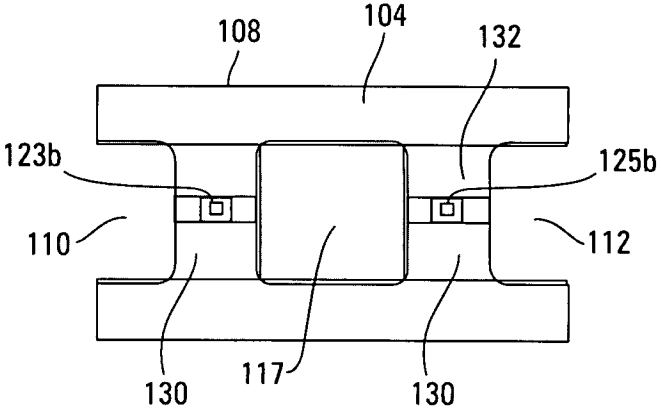
Figure 1C:
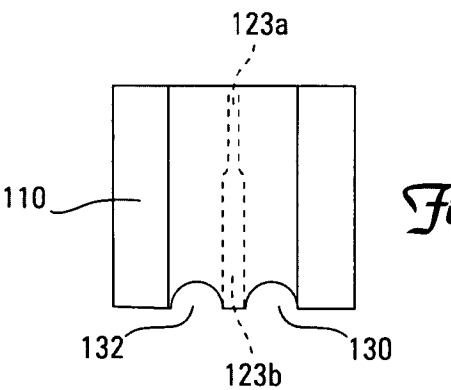

FIGS. 1A to 1C illustrate perspective, bottom and side views respectively of a block 100 suitable for use in practicing the methods of this invention. The block comprises opposing and substantially parallel upper and lower surfaces 102 and 104 respectively, and opposing and substantially parallel front and back faces 106 and 108, respectively. For the purposes of this description, front face 106 is shown facing the viewer in FIG. 1A, however, it is to be understood that front and back can be interchangeable when both front and back faces of the blocks are similarly textured when used in the same wall system. The block also comprises opposing side surfaces 110 and 112. Front face 106 and rear face 108 each extend from top surface 102 to bottom surface 104 and side wall surfaces or ends 110 and 112 each extend from top surface 102 to bottom surface 104 and from front face 106 to rear face 108.

Block 100 further comprises front portion 114 and back portion 116 each connected to the other by neck portions 122 and 124. This configuration forms a core 117 between neck portions 122 and 124 and first side wall indentation 136 between end legs 133 and 135, and second side wall indentation 138 between end legs 137 and 139 at each end of the block. In the drawing figures the end legs are shown as being identically sized which is advantageous in constructing straight walls. Curved walls may be constructed by shortening one or more of the end legs, either by forming the block in that manner or by field splitting the end legs. Neck portions 122 and 124 are positioned laterally along the width of the block. This positioning allows the neck portions of each block to align with the neck portions of blocks above and below the block when a wall is built in a running bond pattern as illustrated in FIG. 7. The side wall indentations 136 and 138 are sized so that adjacent indentations of adjacent blocks in a course of the wall form an opening between the upper and lower surface of the blocks which is vertically aligned with and substantially the same size as cores 117 of blocks in adjacent upper and lower courses. Thus a wall constructed with blocks 100 in a running blond pattern will have a plurality of vertical openings from the top of the wall to the bottom which can accommodate vertical reinforcing members and also provide a path for pouring the concrete footing as will be described in more detail hereafter. The lower surface of each block is provided with channels 130 and 132 that are substantially parallel to the front and back surfaces of the block. Channels 130 and 132 each have a depth and a profile configured to receive a horizontal reinforcing member, as described further below. Channels 130 and 132 open onto side surfaces 110 and 112.

Figure 1D:
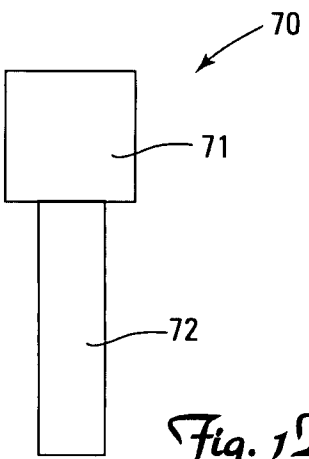
FIG. 1D illustrates a front view of a pin for the dry-stack wall block system of the present invention.

FIG. 1D illustrates pin 70 that can be used to assist in securing a course of block to another course of block. The pin has head 71 and shaft 72. The head 71 and shaft 72 may have circular cross-sections or may have other shapes such as square or rectangular cross-sections. The head has a larger diameter or cross-sectional area than the shaft. The head may also be tapered from a larger area or diameter closest to the shaft and decreasing in size away from the shaft. Neck portion 122 of upper face 102 contains pin hole 123*a* and neck portion 124 of upper face 102 contains pin hole 125*a*. Pin holes 123*a* and 125*a* are sized to accommodate shaft 72 of pin 70. Neck portion 122 of lower face 104 contains pin receiving aperture 123*b* and neck portion 124 of lower surface 104 contains pin receiving aperture 125*b*. Pin receiving apertures 123*b* and 125*b* are sized to accommodate head 71 of pin 70. Pin receiving aperture 123*b* and pin hole 123*a* preferably form a continuous cavity that extends the thickness of the block within neck portion 122. Pin receiving aperture 125*b* and pin hole 125*a* preferably have a continuous cavity that extends the thickness of the block within neck portion 124. The shape of the opening of the pin receiving aperture and pin hole preferably may be of a square or rectangular shape to lock the head and the shaft of the pin securely in place although other shapes such as circular may be used. The opening of the pin hole may be of a smaller area or diameter to accommodate the smaller area or diameter of the pin shaft.

The blocks are made of a rugged, weather resistant material, preferably (and typically) zero-slump molded concrete. Other suitable materials include wet cast concrete, plastic, reinforced fibers, wood, metal and stone. Blocks of this invention are typically manufactured of concrete and molded in a masonry block machine. The block's dimensions are selected not only to produce a pleasing shape for the wall, but also to permit ease of handling and installation. In addition, the dimensions of the channels and the pin receiving cavities are selected as desired.

Providing a large core (i.e., large relative to the overall block size) is preferred because it results in a reduced weight for the block, thus permitting easier handing during installation of a retaining wall. Additionally, the core should be of sufficient size to provide adequate coverage of concrete grout around the vertical steel support members contained within the vertical columns formed by the aligned cores and indentations. For example, industry standards may require a minimum of 1.5 inches (3.8 cm) of coverage for reinforcement within the block shell (core).

Figure 2B:
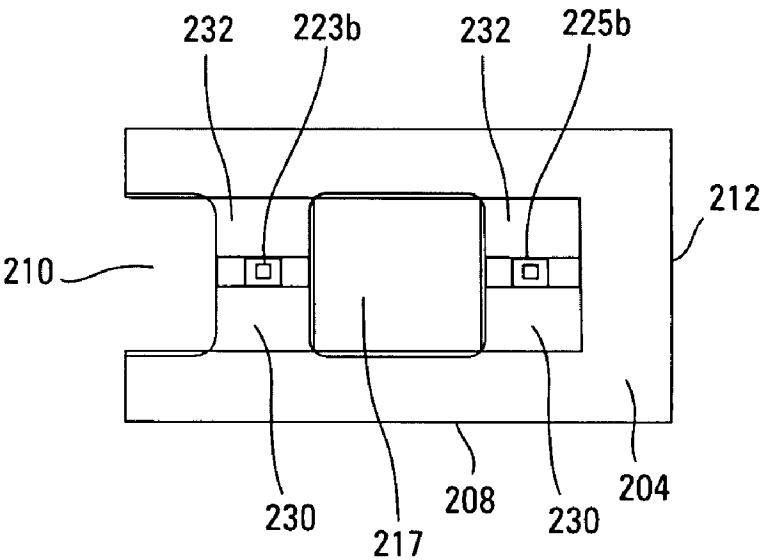
FIGS. 2A and 2B illustrate perspective and bottom views of a second retaining wall block suitable for use in practicing the present invention.
Figure 2A:
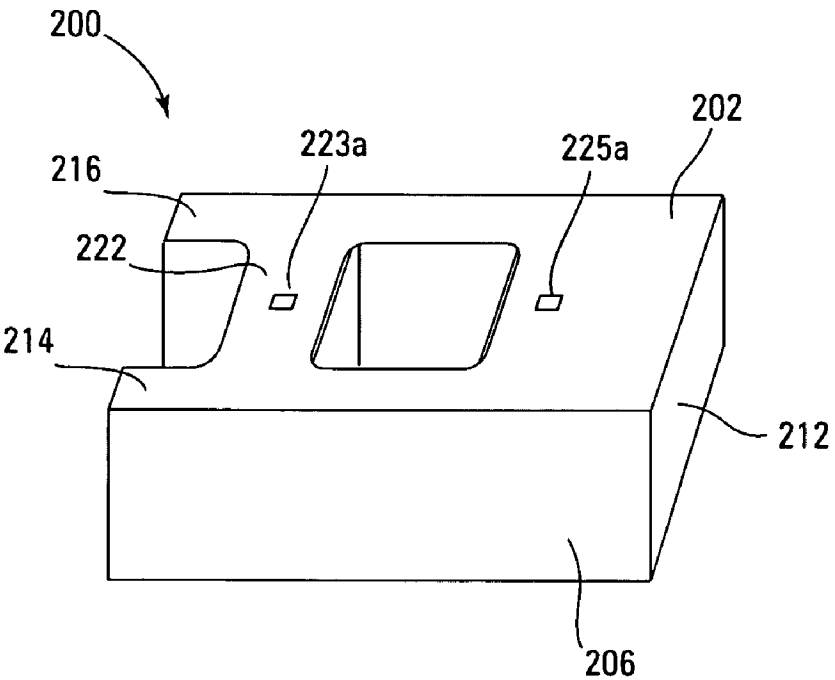

FIGS. 2A and 2B illustrate a corner or end block 200. The corner block 200 is substantially similar to block 100. The block comprises opposing and substantially parallel upper and lower surfaces 202 and 204 respectively, and opposing and substantially parallel front and back faces 206 and 208, respectively. The block also comprises opposing side surfaces 210 and 212. Front face 206 and rear face 208 each extend from top surface 202 to bottom surface 204 and side wall surfaces 210 and 212 each extend from top surface 202 to bottom surface 204 and from front face 206 to rear face 208. Block 200 comprises front ear 214 and back ear 216 each connected to the other by neck or web portion 222 forming side wall surface 210 which has a U-shaped appearance. Side wall surface 212 is continuous with front face 206 and back face 208. Block 200 is provided with core 217 that extends through the thickness of the block. Upper surface 202 contains pin holes 223*a* and 225*a*. The lower surface of each block is provided with channels 230 and 232 that are substantially parallel to the front and back surfaces of the block. Channels 230 and 232 each have a depth and a profile configured to receive a horizontal reinforcing member, as described further below. Channels 230 and 232 open onto side surfaces 210. Lower surface 204 is also provided with pin receiving aperture 223*b*, which forms a continuous cavity with pin hole 223*a* and pin receiving aperture 225*b* which forms a continuous cavity with pin hole 225*a*. Side surface 212 may have a similar texture to the front and back faces and therefore block 200 can be exposed on three sides.

Figure 3B:
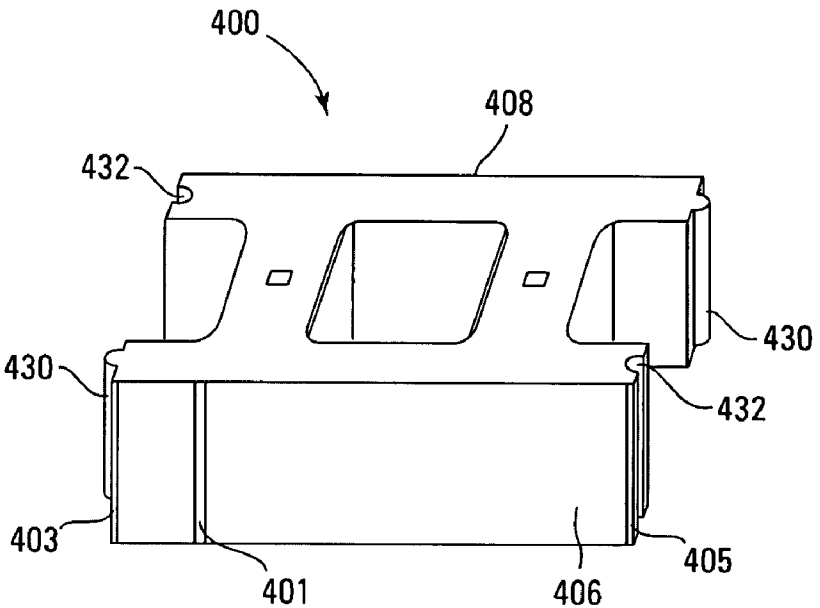
FIGS. 3A and 3B illustrate perspective views of second and third embodiments of a retaining wall block suitable for use in practicing the present invention.
Figure 3A:
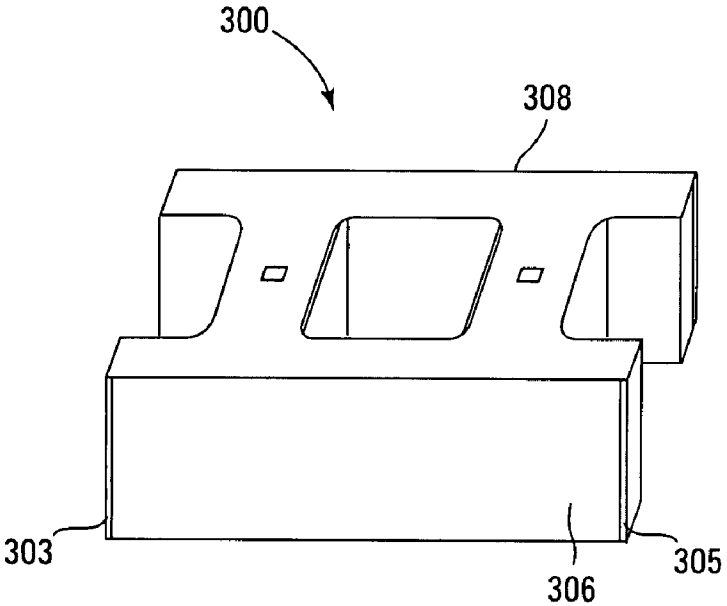

FIGS. 3A and 3B illustrate different embodiments of the wall blocks shown in FIGS. 1A to 1C and are substantially similar to block 100. FIG. 3 illustrates block 300 in which front and back faces 306 and 308 have been provided with beveled ends 303 and 305. It is to be understood that the bevels could be placed on one or both of the faces.

FIG. 3B illustrates block 400 in which front and back faces 406 and 408 have been provided with beveled ends 403 and 405 and also notch or groove 401. It is to be understood that the bevels and groove could be placed on one or both of the faces or that one or both sides could be provided with the groove but not the bevels. It is also to be understood that the bevels and/or grooves could also be applied to end or corner block 200. The purpose of the bevels and grooves is to enhance the appearance of the wall by making the individual blocks stand out and/or give the wall the appearance of being formed of multiple size blocks.

Figure 4A:
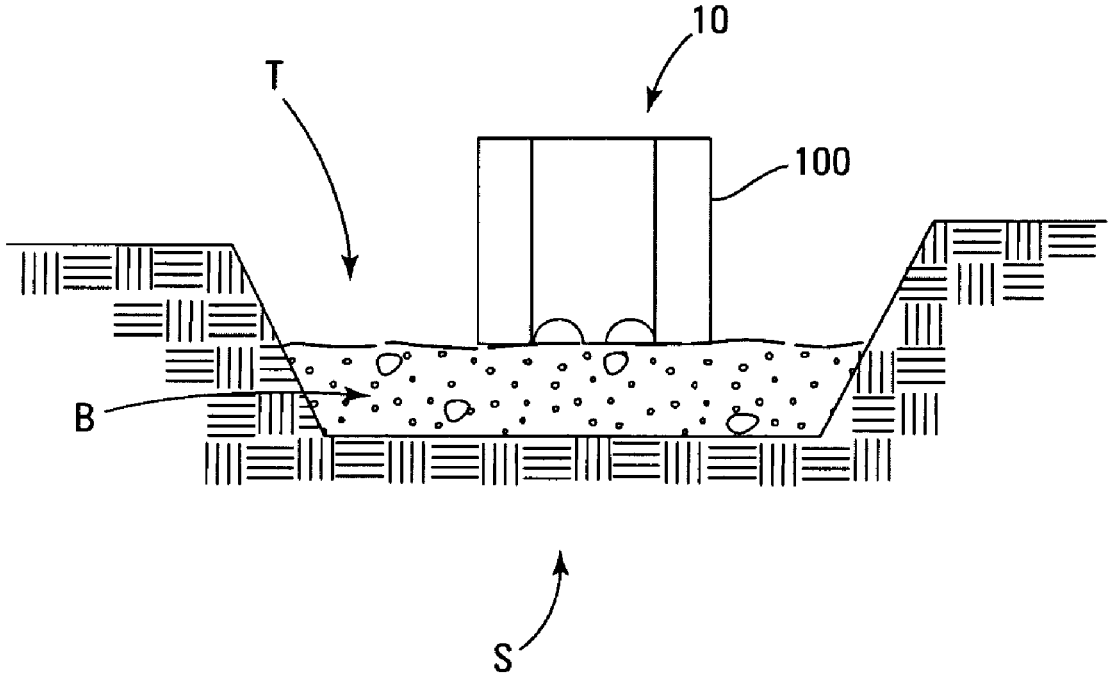
FIGS. 4A and 4B illustrate sectional and top views of a base layer of the block wall system suitable for use in practicing the present invention.
Figure 4B:
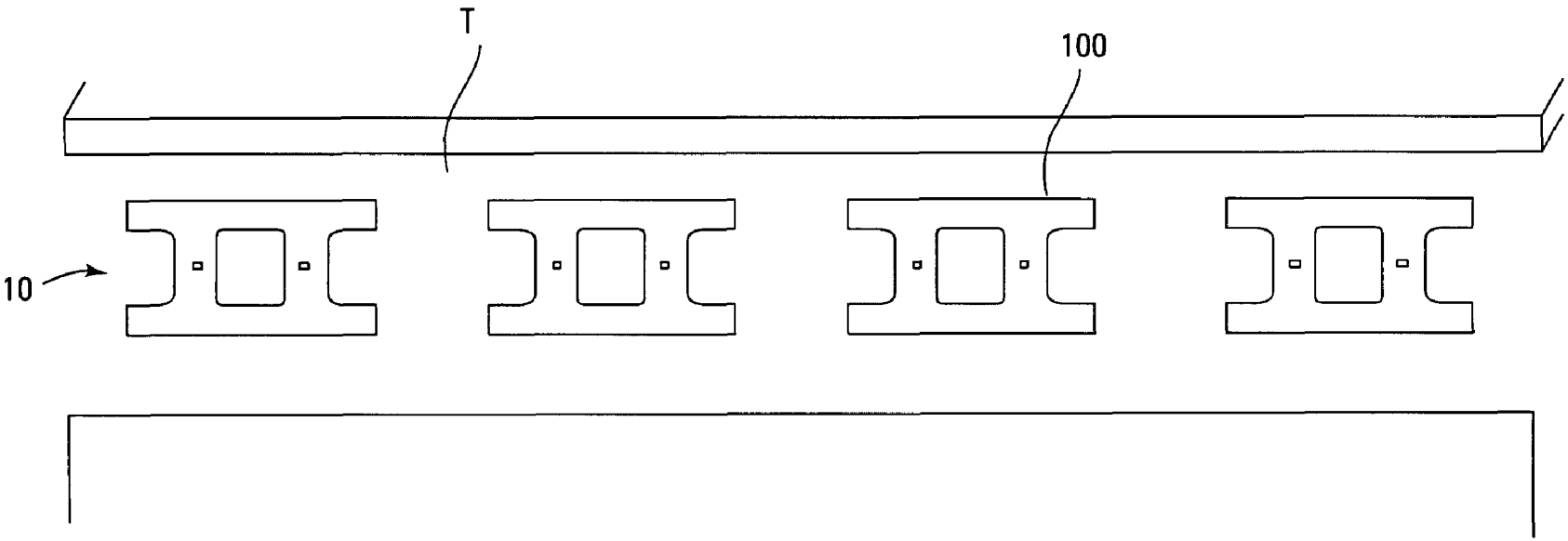

Block 400 has also been provided with a side connection system wherein a side of the block is provided with a channel or slot 432 that is configured to engage a corresponding projection 430 on an adjacent block. There may be one or more channels or slots (and corresponding projections) on the block. Block 400 is shown with a projection 430 and a channel 432 on each side on the block but it is to be understood that both channels could be on one side of the block and both projections could be on the other side. Typically, and preferably, the side connection system is used on a smooth, untextured side of the block. The side connection system is a particular advantage in the construction of free-standing walls. This is because the side connection further stabilizes the wall and because the slots and projections prevent light from showing through the wall and together provide for a close fit of the blocks in the wall Referring now to FIGS. 4 to 7 a method of constructing a freestanding wall or fence with a plurality of blocks 100 and 200 will be described. FIGS. 4A and 4B are side sectional and top views of an excavated trench T of a pre-selected depth, which has been dug into soil S to which is added a level base B of compacted granular material such as crushed stone. The depth of trench T is dependent on factors such as frost depth in soil for specific regions, and scour potential of the footing. A base layer 10 of blocks 100 is formed by the placement and leveling of blocks 100 onto the granular material of the excavated trench. Each block 100 in the base course is placed so lower surface 104 lays directly on top of the granular material. The blocks of base layer 10 are spaced apart from adjacent blocks of the layer by a predetermined distance. This distance may be one half the length of the blocks. Thus, for blocks which are 18 inches long (45.7 cm), a 9 inch (22.9 cm) gap may be provided between each of the blocks. It should be noted that the blocks of the base layer may not be spaced apart and may instead have cut-away portions or knockout portions that would allow for the applications as described below.

Figure 5:
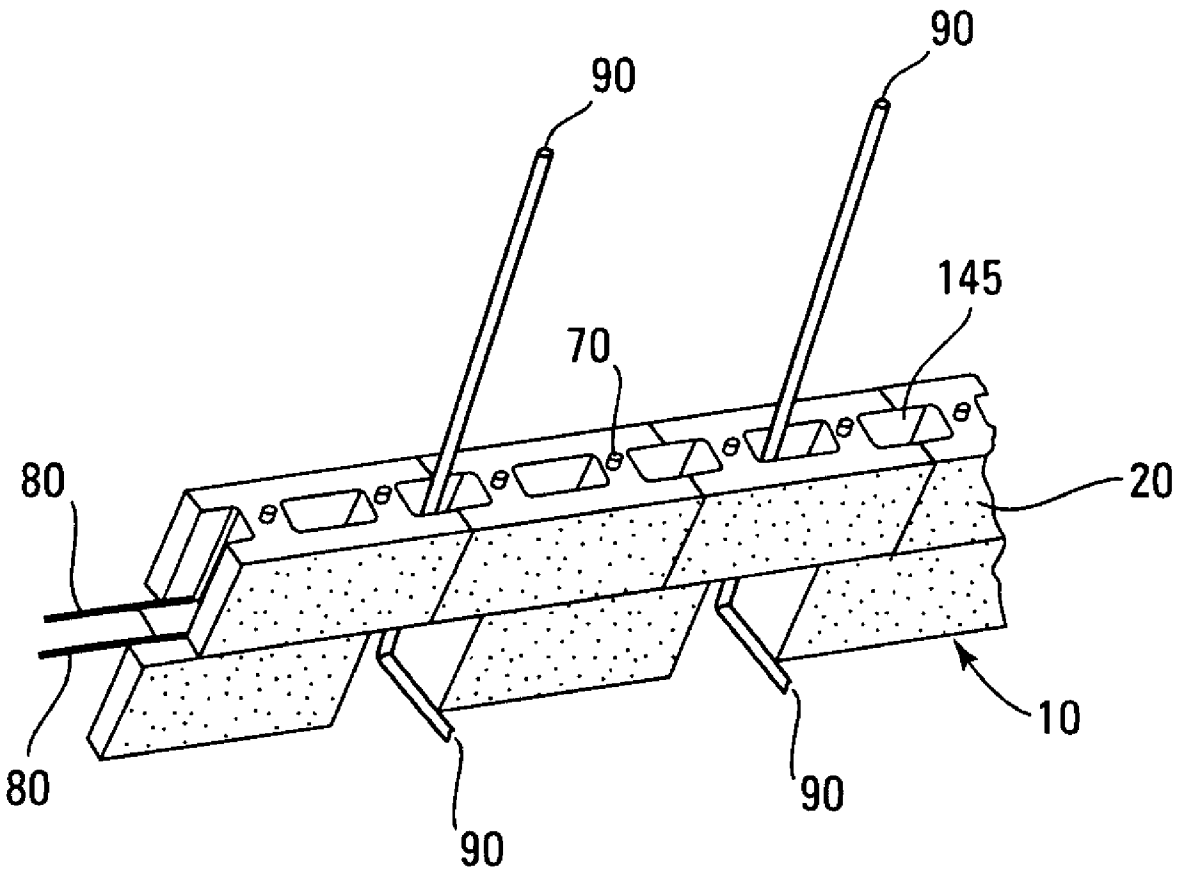
FIG. 5 illustrates a perspective view of a base layer and first course of blocks laid in accordance with the present invention

FIG. 5 shows first course 20 of blocks 100 stacked upon base layer 10. Two rows of horizontal reinforcement members 80 are placed parallel on the top surface of block 100 of base layer 10. Pin 70 is placed into each pin hole of each block 100 in the base layer. The placement of the pin in each pin hole is preferably repeated in each subsequent course. Blocks 100 of first course 20 are placed end to end upon base layer 10. The side wall indentations of each block when placed end to end form an enclosed vertical cavity 145. Channels 130 and 132 of the lower surface of block 100 of first course 20 capture the two rows of horizontal reinforcement members placed on the top surface of base layer 10. Pin receiving apertures 123*b* and 125*b* of the lower surface of block 100 of first course 20 capture the head 71 of pin 70 which has been fitted with a square or rectangular head to lock or secure the head into place inside the aperture. Horizontal reinforcement members 80 can be placed on the top surface of the first course of blocks and then added at other locations as desired or in accordance with the requirements of the wall being built. For example, subsequent horizontal reinforcement members may be spaced at approximately 24 inch (61 cm) vertical spacing intervals. The horizontal members can be placed on every other course, every third course, or any combination thereof. It should be noted that although a particular block structure is disclosed for construction of the wall, other and different block structures could be used. Further, the wall could be constructed from multiple types of blocks. For example, the base layer could have a structure different from the blocks used in the first or subsequent courses of blocks.

Vertical reinforcement members 90 are placed into either enclosed cavity 145, formed by placing the blocks end to end, or core 117 of the first course, whichever opening is directly above the gap created by the placement of the blocks of base layer 10. The vertical reinforcement members are preferably L-shaped, having a perpendicular leg portion and a vertical portion. The perpendicular leg of vertical reinforcement member 90 is placed through the desired opening and protrudes outward through the 9 inch gap and perpendicular to the first course. The vertical reinforcement members can be inserted through the cavities during the laying of the first course or can be inserted during a later course, however they must be inserted before the perpendicular leg of the vertical reinforcement member can no longer be placed or threaded through the cavity and out through the base layer gap. The desired height of the structure may be taller than the vertical reinforcing members themselves. In this case an additional straight vertical reinforcement member can be spliced onto or overlapped with the initial or first stage vertical reinforcement member. The horizontal reinforcement members (two per course where required) are used to position and align the vertical reinforcement member in the open core space or vertical column when placing the vertical steel into the wall after the wall has been assembled but before grouting. Thus there can be much variation with the height of the structure.

Figure 6:
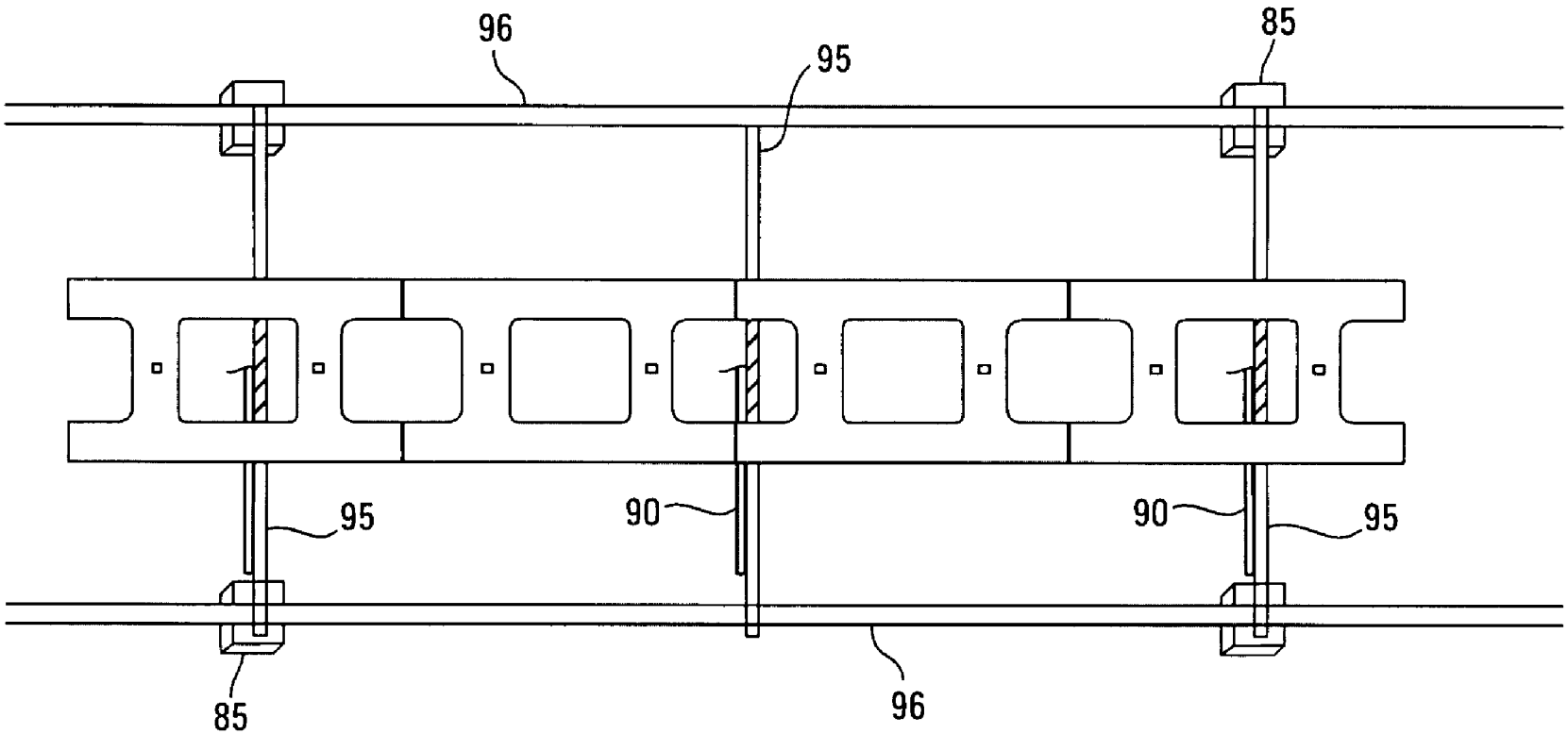
FIG. 6 illustrates a top view of a wall shown with internal vertical steel reinforcing for the block wall and the horizontal framework for support footing for the block wall constructed in accordance with the present invention.

FIG. 6 is a top view of a wall and support footing framework for the wall system of the present invention. The support footing framework includes horizontal footing reinforcing members 96 and transverse footing reinforcing members 95. The perpendicular leg of the vertical reinforcement member 90 is shown without the vertical leg for purposes of illustration in FIG. 6 and is secured by wire or other known methods to the traverse footing reinforcing members 95. The traverse footing reinforcing members protrude outward on both sides of the 9 inch gap and are perpendicular to the first course of block. Horizontal footing reinforcing members 96 are secured by wire or other known methods to the transverse footing members and run parallel the length of the freestanding wall. The horizontal footing members and traverse footing members create a framework for the reinforcement of the concrete footing. The framework is elevated above the granular material by the height of rebar blocks 85 which are attached at various positions to the footing framework and help support the framework. The size of the rebar block can be selected to achieve a desired height in order to ensure proper placement of reinforcing members and footing specifications for support requirements. The footing framework can be completed at anytime during the laying of the wall block courses. It may sometimes be beneficial to wait until all course layers have been laid so that block installers will not trip over or be hindered by the reinforcement framework during construction of the wall.

The horizontal, vertical and traverse reinforcement members are selected of suitable diameter for structural support, moment resistance and integrity and can be made from suitable materials including but not limited to steel reinforcing bars (also referred to as "rebar", which may be deformed, natural and/or galvanized according to project requirements), threaded steel (galvanized) post-tension rods, fiberglass rods, or other reinforcing members that are suited for reinforcement in concrete/masonry.

Figure 7A:
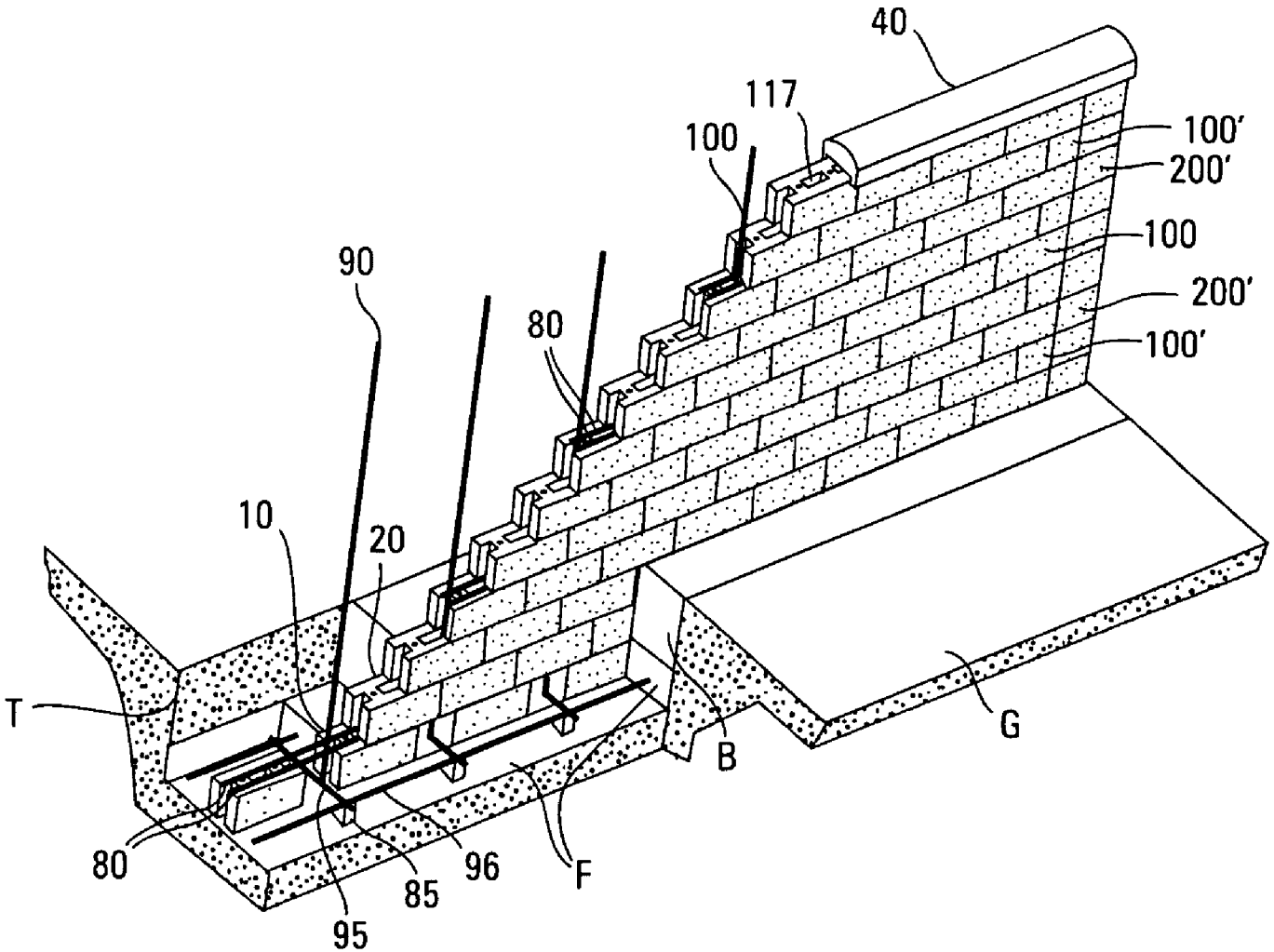
FIGS. 7A and 7B illustrate perspective and front views of block walls constructed in accordance with the present invention.

FIG. 7A illustrates an unfinished reinforced portion of a freestanding wall in partial cross-section. The wall comprises multiple courses of blocks stacked in a running bond pattern until the end of the wall where the end is formed of blocks in a stacked bond pattern as described hereafter.

The wall is constructed in accordance with the method described above. A trench T is dug and prepared with a level base B. A base layer 10 of blocks 100 is then placed over the level base. Blocks 100 are then stacked in courses over the base layer. In the wall of FIG. 7A the blocks are placed in a running bond pattern. Other stacking patterns such as stacked bond could be used as desired so long as cores or other portions of the blocks align to form vertically open columns or cavities. Horizontal and vertical reinforcement members are placed as desired as described above. When the desired height of the wall has been reached and the support footing framework is in place, concrete is poured into the top opening of the vertical columns or cavities housing the vertical reinforcing members. The concrete is poured from the top of the wall and will fill the vertical columnar cavity created by the vertical alignment of the side wall indentations and cores 117 of blocks 100. The concrete will flow down through the wall cavities or voids and out through the gaps of base layer 10 that are created by the spacing of the base course blocks as specified above to form footing F. Footing F fills the trench and covers the footing framework to a predetermined depth and encases the base layer 10 into the footing support structure.

Typically the concrete will be poured after the wall has been constructed to its desired height. It is possible, however, to pour the concrete before the wall is built to its full height. In that case the remainder of the wall is constructed after the concrete is poured. Once the wall is built to its full height additional concrete may be poured into the wall cavities if necessary or desirable.

After the concrete has been poured any extra vertical reinforcing members that extend above the last course of block may be cut off (this could be done before the concrete is poured into the columnar cavities) and capping block 40 may be placed and secured to the top surface of the last course.

As shown in FIG. 7A, end blocks 200 have been cut (or formed) in half to form blocks 200' with the three textured sides at the end of the wall. These blocks 200' are placed in a stacked bond configuration. Alternatively block 200 could be used full sized and placed in a stack bond configuration at the end of the wall. In the embodiment shown in FIG. 7A, the running bond pattern of blocks 100 meet with the stacked bond configuration of blocks 200' and blocks 100 of alternate courses are cut in half to form blocks 100'.

Figure 7B:
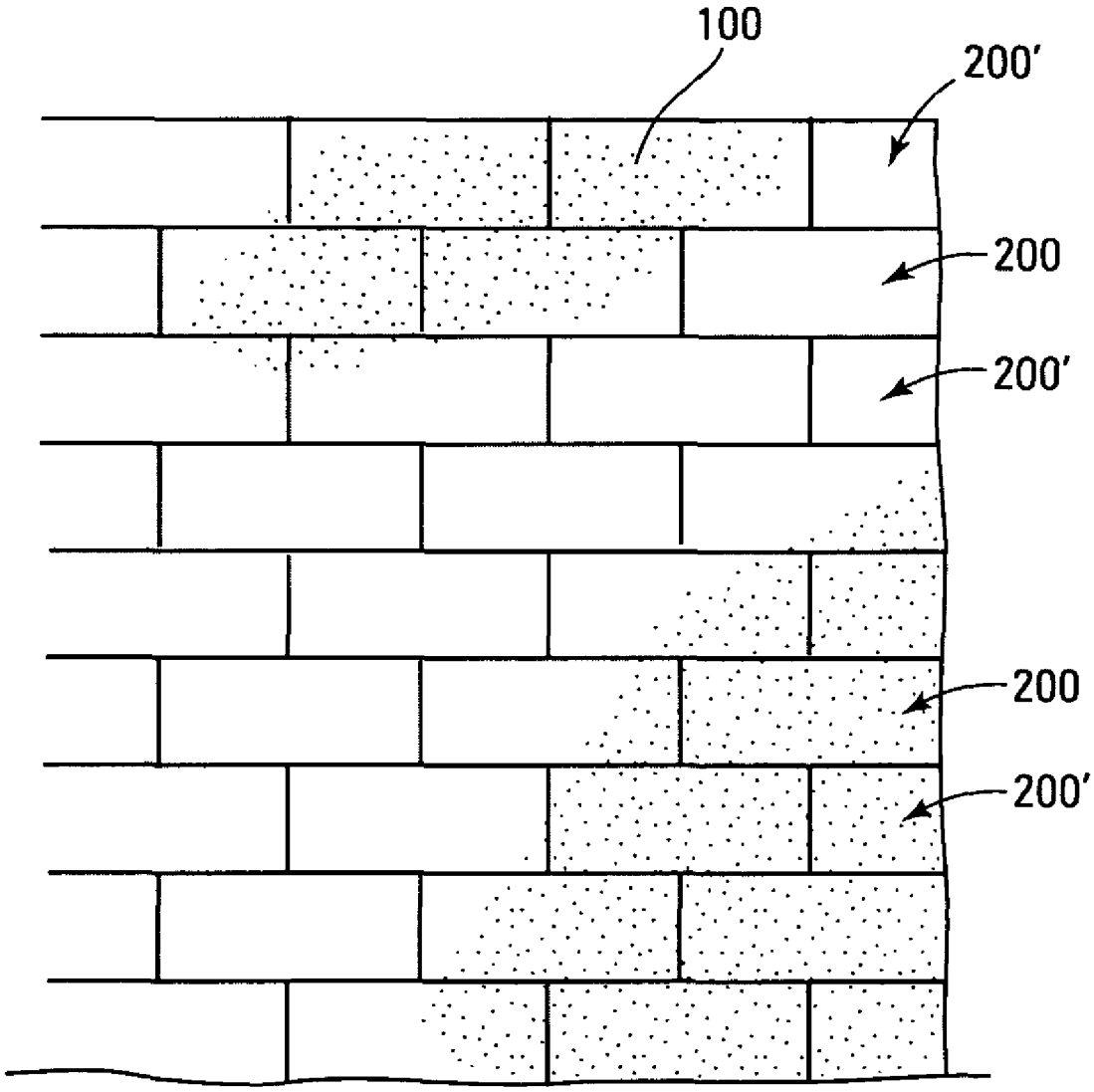

In FIG. 7B the running bond pattern is maintained to the end of the wall. In every other course blocks 200 are cut in half to form blocks 200' with the three textured sides at the end of the wall. It will be understood that the wall can be constructed with one or more 90° corners. In that case blocks 200 are used at the corners with blocks in alternating courses being rotated 90° with respect to one another at each corner. The end or corner blocks and the capping blocks are added to give the wall a more professional and finished look. When the concrete footing in the trench has set and cured, the trench is backfilled with soil S and/or base material B to the level of the finished grade G of the terrain.

The ability to pour the concrete footing of the wall during or after construction of the structure using the monopour method of the present invention enhances and improves the buildability of the wall or fence structure by allowing the contractor to build the wall or fence without the interference of the footing framework. It also allows the contractor to stage their work as appropriate and allows them the flexibility to pour the concrete for the wall footing when it is most advantageous to their work phase. Additionally, pouring of the concrete grout for the reinforcement of the wall is assisted by the gaps in the base layer of blocks, performing the role of support to the wall above as well as providing a visual assurance that the concrete grout is fully filling the block cavity and encasing the vertical steel reinforcement members as required in ASTM Standards.

Although particular embodiments have been disclosed herein in detail, this has been done for purposes of illustration only, and is not intended to be limiting with respect to the scope of the claims. In particular, it is contemplated that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A method for constructing a wall or fence comprising:

preparing a level base;

laying a base layer of blocks on the base, the base layer of blocks forming a plurality of lateral gaps;

stacking a plurality of courses of wall blocks on the base layer of blocks such that a plurality of vertical channels are formed between a top surface of an uppermost course of blocks and the plurality of gaps in the base layer of blocks;

pouring a flowable material from the top surface through the vertical channels and gaps to form a support footing for the wall or fence which substantially encases the base layer of blocks; and forming a footing reinforcing framework for the support footing after stacking a plurality of wall blocks and prior to pouring the flowable material, the reinforcing framework including horizontal footing reinforcing members extending parallel to the wall or fence and transverse footing reinforcing members extending perpendicular to the wall or fence, the footing reinforcing framework being substantially encased in the support footing after the flowable material is poured.

2. The method of claim 1 further comprising;

forming a trench; and adding base material to the trench, wherein the step of preparing a level base comprises leveling the base material in the trench.

3. The method of claim 2 wherein the base material is compacted granular material or crushed stone.

4. The method of claim 1 wherein the flowable material is concrete or cement.

5. The method of claim 1 wherein the transverse footing reinforcing members extend through the plurality of gaps in the base layer of blocks.

6. The method of claim 1 further comprising:

placing vertical reinforcement members within the vertical channels prior to pouring the flowable material.

7. The method of claim 1 further comprising:

placing horizontal reinforcing members between courses of wall blocks.

8. The method of claim 1 wherein the wall blocks and the base layer blocks have the same structure.

9. The method of claim 1 wherein the lateral gaps are formed by spacing blocks in the base layer apart by a distance d.

10. The method of claim 9 wherein distance d is about one-half of a length of a base layer block.

* * * * *